United States Patent [19]

Secor

[11] Patent Number: 4,634,452

[45] Date of Patent: Jan. 6, 1987

[54] PREPARATION OF TALL OIL FUEL BLEND

[75] Inventor: Robert J. Secor, Pointe Claire, Canada

[73] Assignee: Canadian Patents and Development Ltd/Société Canadienne des Brevets et d'Exploitation Limitée, Ontario, Canada

[21] Appl. No.: 850,555

[22] Filed: Apr. 11, 1986

[30] Foreign Application Priority Data

Apr. 12, 1985 [CA] Canada ..... 479072

[51] Int. Cl.[4] ..... C10L 1/18

[52] U.S. Cl. ..... 44/66

[58] Field of Search ..... 44/66

[56] References Cited

U.S. PATENT DOCUMENTS

| | | | |
|---|---|---|---|
| 1,913,970 | 6/1933 | Albers | 44/66 |
| 2,646,349 | 7/1953 | Wagner | 44/66 |
| 2,686,713 | 8/1954 | White et al. | 44/66 |
| 2,908,676 | 10/1959 | Van Valkenburgh | 260/97.5 |
| 3,667,152 | 6/1972 | Eckert | 44/66 |
| 3,948,874 | 4/1976 | Palmqvist | 260/97.7 |

FOREIGN PATENT DOCUMENTS

| | | |
|---|---|---|
| 914411 | 5/1969 | Canada . |
| 821825 | 10/1959 | United Kingdom . |

*Primary Examiner*—Y. Harris-Smith

*Attorney, Agent, or Firm*—Berman, Aisenberg & Platt

[57] ABSTRACT

A fuel blend comprising tall oil and mineral and/or vegetable oil, and a process for making such a fuel blend. The process comprises heating a mixture of from 10 to 90 percent crude tall oil with the balance being mineral and/or vegetable oil to a temperature ranging from 35° C. to about 100° C. for a period of time sufficient to agglomerate the lignin-like dispersed substances in the mixture. The agglomerated lignin-like substances are then separated from the mixture. The fuel blend of the present invention has a significantly reduced total volume of remaining solids, positively influencing the life of the fuel filters when used in internal combustion engines.

24 Claims, No Drawings

PREPARATION OF TALL OIL FUEL BLEND

The present invention relates to a fuel mixture and to a process for its preparation. More particularly, the fuel mixture of the present invention is a blend of tall oil and mineral oil and/or vegetable oil suitable for use as a fuel in internal combustion engines.

BACKGROUND OF THE INVENTION

Tall oil is a by-product of alkaline pulping processes of resinous wood species for the manufacture of chemical pulps. It is well known to be a combustible substance. Typically, its calorific value ranges from 35 to 40 MJ/kg. Indeed, the burning the tall oil in power boilers is a common practice in many industrial plants. Over the years, various attempts have been made to use tall oil as a fuel for internal combustion engines. Because of its high viscosity at ambient temperatures, tall oil has frequently been diluted with mineral oil, such as diesel oil. Moncrieff British Patent No. 821,825 discloses the use of tall oil as a stabilization agent in a fuel for an internal combustion engine comprising a blend of mineral oil and alcohol. White U.S. Pat. No. 2,686,713 and Eckert Canadian Pat. No. 914,411 disclose the use of tall oil derivatives as additives to inhibit the corrosivity of commercial diesel fuel, kerosine and gasoline.

It is known by those skilled in the art that a fuel blend comprising crude tall oil and mineral oil or vegetable oil causes frequent plugging of the fuel filter of internal combustion engines. In the past this has seriously discouraged the use of tall oil as a fuel for internal combustion engines. The plugging of the fuel filter has been found to be mainly caused by the ubiquitous presence of lignin-like dispersed substances in the crude tall oil. These lignin-like substances are well dispersed and not easy to remove by conventional means.

In Sullivan U.S. Pat. No. 2,838,481 issued June 10, 1958, a process is described in which a mixture of tall oil and water is heated to about 82° to 93° C., whereby 95 to 98 percent of lignins present are removed. Palmqvist U.S. Pat. No. 3,948,874 issued Apr. 6, 1976 describes and illustrates a method for removing lignin from tall oil in which tall oil obtained after removal of splitting liquid (water) is dried by heating to, for example, 90 to 95 degrees C. This drying process increases the acidity of the tall oil and thereby precipitates lignin. Neither of these prior art references, however, discloses a suitable method of adapting tall oil for use as a fuel for internal combustion engines or a product which would be useful in this way.

Another reference of general background interest, describing the processing of tall oil is U.S. Pat. No. 2,908,676 of Van Valkenburgh issued Oct. 13, 1959.

It is an object of the present invention to provide a fuel blend incorporating tall oil which will be effective for use in internal combustion engines, and which will have reduced contents of lignin-like substances thereby providing extended life to fuel filters of internal combustion engines.

SUMMARY OF THE INVENTION

In accordance with the present invention a process is provided for removing lignin-like substances present in fuel blends comprising crude tall oil and mineral oil and/or vegetable oil. The process comprises the steps of:

(1) heating a mixture of (a) from 10 to 90 percent crude tall oil and (b) a balance of mineral oil or vegtable oil or a combination thereof, to a temperature ranging from about 35° C. to about 100° C. for a period of time sufficient to agglomerate the lignin-like dispersed substances in the mixture and, (2) separating the agglomerated lignin-like substances from the mixture.

The period of time of heating the mixture of crude tall oil and mineral oil, in the first step of the process, will usually be from about one minute to about 120 minutes.

When the process of the present invention is carried out, the effectiveness of the removal of lignin-like dispersed material is quite surprising. The resultant fuel blend has similar clarity to that of the tall oil-free mineral oil or vegetable oil or combinations thereof. The fuel blend manufactured in accordance with the present invention when used in internal combustion engines has been found to provide a substantial improvement in the operating life of the engines' fuel filters.

DETAILED DESCRIPTION OF THE INVENTION

The crude tall oil used in the process of the present invention can been made in any conventional tall oil soap acidulation plant. The fuel blend may range from about 10 percent to about 90 percent crude tall oil, with the balance being mineral oil or vegetable oil or combinations thereof. The mineral oil in the fuel blend may include diesel oil or kerosine. The vegetable oil in the fuel blend may include rapeseed oil, coconut oil, palm oil, corn oil and sunflower seed oil.

The mixture of crude tall oil and mineral oil and/or vegetable oil is heated in an open vessel to a temperature ranging from about 35 degrees C. to about 100 degrees C. for a period of time sufficient to agglomerate the lignin-like substances. These substances include lignin, lignin derivatives, their degradation products and similar dispersed material. This time has been found to be normally within the range of from about one minute to about 120 minutes. It is preferred that the temperature of the heat treatment be below the flash point of the mineral oil or vegetable oil in the original mixture.

After this heating of the mixture, the lignin-like dispersed substances are separated from the treated fuel blend for example by settling by gravity and/or by centrifugation. The supernatant liquid is subsequently decanted as the product fuel blend. This prepared fuel blend may then be filtered in accordance with any of the well known conventional fuel filtration sequences for using in an internal combustion engine.

The following examples are illustrative of the invention:

EXAMPLE NO. 1

A fuel sample comprising 50% crude tall oil (Acid Number 133) and 50% winter-grade diesel fuel was heated in an open glass beaker to 50° C. for 60 minutes. An aliquot of the test sample was gravity-settled overnight. The supernatant was then decanted and passed through a 10-micron paper cartridge filter (Fram Canada Inc. Model P1653—trade mark) to determine the filterability of the prepared fuel sample. The following table compares the filterability of the prepared sample with that of an untreated sample of similar tall oil diesel fuel composition.

TABLE NO. 1

| | FUEL SAMPLE 1 | FUEL SAMPLE 2 |
|---|---|---|
| Heat Treatment | No | Yes |
| % lignin (by volume) in sample after centriguation for: | | |
| 5 minutes | 15.7 | 4.2 |
| 15 minutes | 13.0 | 3.5 |
| 60 minutes | 6.3 | 2.1 |
| Volume of sample filterable, liters | 8.0 | 160.0 |

It is readily evident from an examination of the above table that the present invention provides more effective removal of lignin-like dispersed solids and improved filter volumetric throughput.

EXAMPLE NO. 2

A fuel blend of 50% crude tall oil (acid number 130) and winter-grade diesel fuel was prepared and separated into four aliquots of 200 ml each. Three of these aliquots were heated to 50° C. and maintained at 50° C. for a period ranging from 1 to 120 minutes. The fourth aliquot was not heated.

A 15 ml sample of each aliquot was taken (composite sample). The four aliquots were allowed to settle under quiescent conditions for 30 minutes. A second 14 ml sample was then taken from the top portion of each aliquot (supernatant sample). The eight samples were centrifuged in a laboratory batch centrifuge for 30 minutes at 2880 rpm. The percent solids was recorded in each case.

The results are shown in the following table.

TABLE NO. 2

| Aliquot Number | Heat Treatment | Solids Content After 30 Minutes of Centrifugation (Vol. %) Composite Sample | Supernatant Sample |
|---|---|---|---|
| 1 | Untreated | 4.5 | 4.7 |
| 2 | 50° C. for 1 minute | 1.6 | 0.7 |
| 3 | 50° C. for 60 minutes | 1.4 | 0.9 |
| 4 | 50° C. for 120 minutes | 1.3 | 0.8 |

As can be seen in this example, the method of the present invention provides a clearer supernatant, and suprisingly reduces the total volume of solids in the fuel blend, thereby contributing to greatly extended fuel filter life.

EXAMPLE NO. 3

A fuel blend comprising 10% crude tall oil (acid number 130) and 90% winter-grade diesel fuel was prepared and apportioned into two 200 ml aliquots. One aliquot was heat treated at 50° C. for 60 minutes. The other was left untreated. A 15 ml sample of each aliquot was taken (composite sample). The treated and untreated fuels were left to settle under quiescent conditions for 30 minutes. At this time a second 15 ml sample was taken from the top portion of each aliquot (supernatant sample). The four samples were centrifuged in a laboratory batch centrifuge for 30 minutes at 2880 rpm. The amount of solids present in each case was recorded.

The above procedure was repeated using a fuel blend comprised of 90% crude tall oil (acid number 130) and 10% winter-grade diesel fuel.

The results are shown in the following table.

TABLE NO. 3

| Aliquot Number | Fuel Blend % Crude Tall Oil | Fuel Blend % Diesel Fuel | Heat Treatment | Solids Content After 30 Minutes of Centrifugation (Vol. %) Composite Sample | Supernatant Sample |
|---|---|---|---|---|---|
| 1 | 10 | 90 | Untreated | 1.3 | 0.51 |
| 2 | 10 | 90 | Treated at 50° C. for 60 minutes | 0.38 | 0.97 |
| 3 | 90 | 10 | Untreated | 17.3 | 13.5 |
| 4 | 90 | 10 | Treated at 50° C. for 60 minutes | 0.35 | 0.34 |

As can be seen from this example, the method of the present invention enhances solids separation and reduces the overall solids content in the product mixture, thereby improving its filterability.

EXAMPLE NO. 4

A fuel blend comprising 50% crude tall oil (acid number 130) and 50% pure corn oil (specific gravity 0.917 at 20° C.) was prepared and separated into two aliquots of 200 ml each. The first aliquot was heat treated at 100° C. for 60 minutes. The second aliquot was left untreated.

A 15 ml sample of each aliquot was taken (composite sample). The two aliquots were allowed to settle under quiescent conditions for 30 minutes. A second 15 ml sample was then taken from the top portion of each aliquot (supernatant sample). The four samples were centrifuged in a laboratory batch centrifuge for 30 minutes at 2800 rpm. The percentage solids was recorded in each case.

The above procedure was repeated using a fuel blend comprised of 50% crude tall oil (acid number 130) and 50% pure canola oil (specific gravity 0.918 at 20° C.).

The results are shown in the following table.

TABLE NO. 4

| Aliquot Number | % Crude Tall Oil | % Vegetable Oil | Heat Treatment | Solids Content After 30 Minutes of Centrifugation (Vol. %) Composite Sample | Supernatant Sample |
|---|---|---|---|---|---|
| 1 | 50 | 50 corn | Nil | 18.2 | 15.3 |
| 2 | 50 | 50 corn | Treated at 100° C. for 60 minutes | 0.4 | 0.4 |
| 3 | 50 | 50 rapeseed | Nil | 17.6 | 14.7 |
| 4 | 50 | 50 rapeseed | Treated at 100° C. for 60 minutes | 0.4 | 0.4 |

As can be seen from this example, the present invention reduces the total amount of solids in the fuel blends by as much as 98%. This surprising reduction in solid material in the fuel blend can provide an increase in fuel filter life by as much as 45 times Thus it is apparent that there has been provided in accordance with the invention a novel, useful fuel blend including tall oil, and a process for making such a fuel blend, that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A process for preparing a fuel mixture which comprises:

(1) heating a mixture of (a) from 10 to 90 percent crude tall oil and (b) a balance of mineral oil or vegetable oil or a combination thereof, to a temperature ranging from about 35 degrees C. to about 100 degrees C. for a period of time sufficient to agglomerate the lignin-like dispersed substances in the mixture and, (2) separating the agglomerated lignin-like substances from the mixture.

2. A process according to claim 1 wherein the balance (b) of the mixture is mineral oil.

3. A process according to claim 1 wherein the balance (b) of the mixture is vegetable oil.

4. A process according to claim 1 wherein the balance (b) of the mixture is a combination of mineral oil and vegetable oil.

5. A process according to claim 2 wherein the mineral oil is one or a combination selected from the group consisting of diesel oil and kerosine.

6. A process according to claim 3 wherein the vegetable oil is one or a combination selected from the group consisting of rapeseed oil, coconut oil, palm oil, corn oil and sunflower seed oil.

7. A process according to claim 1 wherein, the heating of the mixture is to a temperature below the flash point of any one oil component in the mixture.

8. A process according to claim 1 wherein the mixture is heated for a period of time from about one minute to about 120 minutes.

9. A process for preparing a fuel mixture which comprises:

(1) heating a mixture of (a) from 10 to 90 percent crude tall oil and (b) a balance of mineral oil or vegetable oil or a combination thereof, to a temperature ranging from 35° C. to about 100° C. for a period of time in the range from about one minute to about 120 minutes, and (2) separating the agglomerated lignin-like substances from the mixture.

10. A process according to claim 1 wherein the separation is carried out by gravity settling of the lignin-like substances from the mixture.

11. A process according to claim 1 wherein the separation is carried out by centrifugation of the lignin-like substances from the mixture.

12. A process according to claim 1 wherein the separation is by a combination of gravity settling and centrifugation of the lignin-like substances from the mixture.

13. A fuel blend comprising a mixture of (a) from 10 to 90 percent crude tall oil and (b) a balance of mineral oil or vegtable oil or a combination thereof, which mixture has been treated according to the method of claim 1.

14. A fuel blend according to claim 13 wherein the balance (b) of the mixture is mineral oil.

15. A fuel blend according to claim 13 wherein the balance (b) of the mixture is vegetable oil.

16. A fuel blend according to claim 13 wherein the balance (b) of the mixture is a combination of mineral oil and vegetable oil.

17. A fuel blend according to claim 14 wherein the mineral oil is one or a combination selected from the group consisting of diesel oil and kerosine.

18. A fuel blend according to claim 15 wherein the vegetable oil is one or a combination selected from the group consisting of rapeseed oil, coconut oil, palm oil, corn oil and sunflower seed oil.

19. A fuel blend comprising a mixture of (a) from 10 to 90 percent crude tall oil and (b) a balance of mineral oil or vegetable oil or a combination thereof, which mixture has been treated according to the method of claim 9.

20. A fuel blend according to claim 19 wherein the balance (b) of the mixture is mineral oil.

21. A fuel blend according to claim 19 wherein the balance (b) of the mixture is vegetable oil.

22. A fuel blend according to claim 19 wherein the balance (b) of the mixture is a combination of mineral oil and vegetable oil.

23. A fuel blend according to claim 20 wherein the mineral oil is one or a combination selected from the group consisting of diesel oil and kerosine.

24. A fuel blend according to claim 21 wherein the vegetable oil is one or a combination selected from the group consisting of rapeseed oil, coconut oil, palm oil, corn oil and sunflower seed oil.

* * * * *